US005545951A

United States Patent [19]

Ziegler et al.

[11] Patent Number: 5,545,951

[45] Date of Patent: Aug. 13, 1996

[54] HIGH POWER STROBE LAMP

[75] Inventors: Byron J. Ziegler, Austin; Mark E. Scurrah, San Marcos, both of Tex.

[73] Assignee: High End Systems, Inc., Austin, Tex.

[21] Appl. No.: 411,900

[22] Filed: Mar. 28, 1995

[51] Int. Cl.[6] ..... H01J 7/44

[52] U.S. Cl. ..... 315/58; 315/32; 315/38; 315/71; 313/285; 313/289; 313/290

[58] Field of Search ..... 315/32, 38, 58, 315/71; 313/266, 285, 289, 290, 331, 343

[56] References Cited

U.S. PATENT DOCUMENTS 3,035,419 5/1962 Wigert ..... 315/38
4,176,292 11/1979 Anderson ..... 315/71
4,179,640 12/1979 Larson et al. ..... 315/58

OTHER PUBLICATIONS

Bulbman Catalog, Sep. 1994, P. 8.

*Primary Examiner*—Frank Gonzalez
*Assistant Examiner*—Reginald A. Ratliff
*Attorney, Agent, or Firm*—James R. Bell

[57] ABSTRACT

A high power strobe lamp has a multi-pin base, an elongated gas-filled tube having a loop formed therein, an anode in one end of the tube and a cathode in the other end of the tube, and the ends of the gas-filled tube being mounted in the base and connected to the pins. A heat dissipating member extends through the loop and a conductive wire, having opposite ends connected to the pins, is spirally wrapped around the tube ends adjacent to the base and extends through the heat dissipating member.

11 Claims, 1 Drawing Sheet

HIGH POWER STROBE LAMP

FIELD OF INVENTION

This invention relates generally to xenon flash lamps and more particularly to lamps used in strobe devices for entertainment lighting applications.

BACKGROUND OF THE INVENTION

Xenon flash lamps used in strobe units generally comprise a base with a multiple-pin connection, a quartz tube filled with xenon gas exposed to an anode in one end of the tube and a cathode in another end. The tube, at the anode and cathode ends, is secured in a potting material in the base and connected to the pins. A braided nickel wire is wound around the tube in a spiral pattern extending from one end of the tube to the other. The wire is connected to receive power through a triggering device connected to the pins and mounted in the base. When the wire is energized, the xenon is excited to a plasma state which causes a flash due to the gas being ionized in the tube between anode and cathode.

In order to make the flash brighter, and of a longer duration, the tube length is extended. However, due to space restrictions, the extra length is provided in the form of a loop in the tube. The loop creates a large heat concentration which is tolerated by the lamp components during normal flash sequences, however, during flashes of increased energy or extended duration, sufficient heat (about 2,000 degrees F.) is generated to melt the nickel wire, thus rendering the lamp inoperable.

The foregoing illustrates limitations of the known prior art. Thus, it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a high power strobe lamp comprising a multi-pin base; an elongated gas-filled tube having a loop formed therein, the tube having one end including an anode and another end including a cathode, the ends being mounted in the base and connected to the pins; a heat dissipating member extending through the loop; and a conductive wire having opposite ends connected to the pins, the wire being spirally wrapped around the tube ends adjacent to the base and extending through the heat dissipating member.

The foregoing and other aspects will become apparent from the following detailed description of the; invention when considered in conjunction with the accompanying drawing figures. It is to be expressly understood, however, that the figures are not intended as a definition of the invention, but are for the purpose of illustration only.

BRIEF DESCRIPTION OF THE DRAWINGS FIGURES

FIG. 1 is a side view illustrating an embodiment of the lamp of the present invention; and FIG. 2 is a view of the lamp taken along the line 2—2 of FIG. 1.

DETAILED DESCRIPTION OF THE INVENTION

Figure 1:
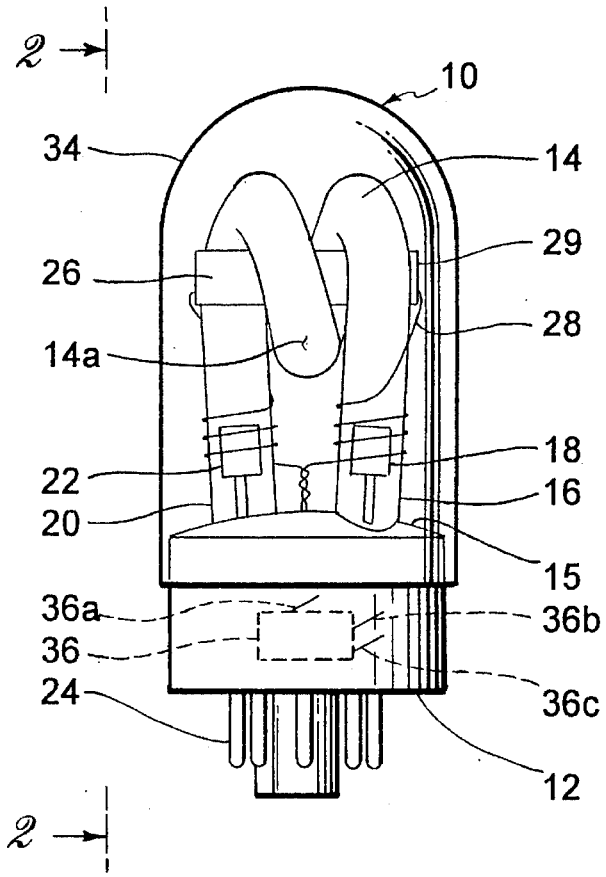
Figure 2:
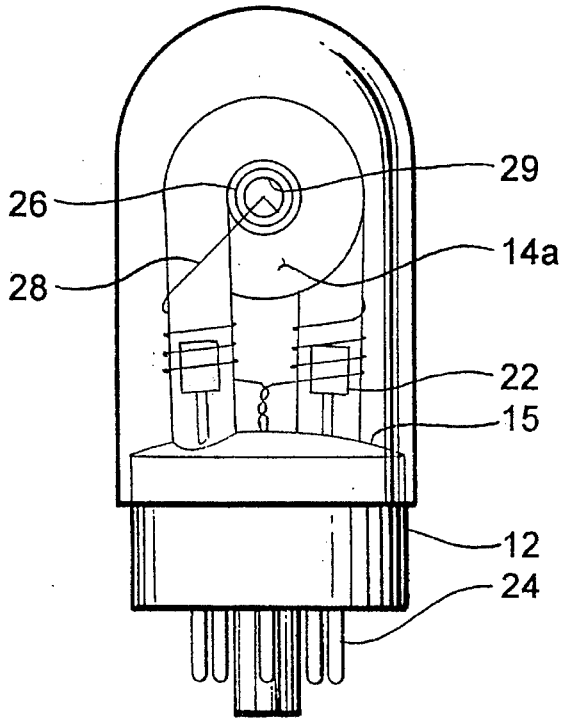

Referring now to the drawings, FIG. 1 illustrates a high power strobe lamp 10, including an eight-pin phenolic base 12, an elongated xenon-filled tube 14, formed of fused quartz and having a loop 14*a* formed therein. One end 16 of tube 14 includes a thoreated tungsten anode 18 and another end 20 includes a sintered cathode 22. Ends 16 and 20 are mounted in base 12, which includes a zirconium based potting material 15, and connected to pins 24. Cathode end 20 of tube 14 is connected to pins 1 and 8 of base 12. Anode end 16 of tube 14 is connected to pins 5 and 6.

A heat dissipating member 26, such as a piece of metal tubing extends through loop 14a and functions as a heat sink to assist in removing the concentrated heat generated in the loop 14a portion of lamp 14. Member 26 may be of various shapes and may be solid, but is preferably a piece of tubing formed of the metal alloy product sold under the name INCONEL.

A conductive wire 28, preferably of nickel, has opposite ends 30 and 32 which are preferably interconnected. The pin connections will be discussed later in greater detail. Wire 28 is spirally wrapped around ends 16 and 20 of tube 14 adjacent to the base 12. Wire 28 also extends through an opening 29 in metal tube 26. In this manner wire 28 is exposed to a limited amount of the heat concentrated in the loop 14*a* portion of lamp 14.

A dome 34 of ultra-violet blocking material is attached to base 12 and encloses the ultraviolet light ray producing tube 14, wire 28 and tube 26. Dome 34 is preferably formed of the glass product sold under the name PYREX. Dome 34 is preferably sealed to base 12 by a suitable silicone material.

A triggering device 36 is mounted in clay 15 and is connected to pins 24 of base 12 and to wire 28. Triggering device 36 is preferably the model FG 3276-1 sold by Actown Electrocoil, Inc. of Spring Grove, Ill. A first wire connection 36*a* of device 36 is connected to both ends 30, 32 of nickel wire 28. A second wire connection 36*b* is connected to pin 3 of base 12. Also, a third wire connection 36*c* is connected with cathode 22 to pins 1 and 8 of base 12.

While this invention has been illustrated and described in accordance with a preferred embodiment, it is recognized that variations and changes may be made therein without departing from the invention as set forth in the claims.

Having described the invention, what is claimed is:

1. A high power strobe lamp comprising:

a multi-pin base;

an elongated gas-filled tube having a loop formed therein, the tube having one end including an anode and another end including a cathode, the ends being mounted in the base and connected to the pins;

a heat dissipating member extending through the loop; and a conductive wire having opposite ends connected to the pins, the wire being spirally wrapped around the tube, ends adjacent to the base and extending through the heat dissipating member.

2. The lamp as defined in claim 1 wherein the gas is xenon.

3. The lamp as defined in claim 1 wherein the heat dissipating member is a metal tube.

4. The lamp as defined in claim 3 wherein the metal tube is formed of Inconel.

5. The lamp as defined in claim 1 wherein the wire is formed of nickel.

6. The lamp as defined in claim 1 wherein the gas-filled tube is formed of fused quartz.

7. The lamp as defined in claim 1, and further including:

a dome formed of ultra-violet blocking material is attached to the base and encloses the gas-filled tube, the conductive wire and the heat dissipating member.

8. The lamp, as defined in claim 7, wherein the ultra-violet blocking material is glass.

9. The lamp as defined in claim 7, wherein the ultra-violet blocking material is Pyrex.

10. A high power strobe lamp comprising:

a multi-pin base;

a triggering device mounted in the base and connected to the pins;

an elongated xenon filled tube having a loop formed therein and also having opposite ends, one end including an anode and the other including a cathode, the ends being mounted in the base and connected to the pins;

a heat dissipating member extending through the loop; and a conductive wire having opposite ends connected to the triggering device, the wire being spirally wrapped around the tube ends adjacent to the base and extending through the heat dissipating member.

11. A high power strobe lamp comprising:

a multi-pin base;

a triggering device mounted in the base and connected to the pins;

an elongated xenon filled glass tube having a loop formed therein and also having opposite ends, one end including an anode and the other including a cathode, the ends being mounted in the base and connected to the pins:

a metal tube extending through the loop; and a conductive wire having opposite ends connected to the triggering device, the wire being spirally wrapped around the glass tube ends adjacent to the base and extending through the metal tube.

* * * * *